US005962822A

United States Patent [19]

May

[11] Patent Number: 5,962,822

[45] Date of Patent: Oct. 5, 1999

[54] MUFFLER/EXHAUST EXTRACTOR AND METHOD

[76] Inventor: Daniel A. May, 400 S. Columbia St., Wenatchee, Wash. 98801

[21] Appl. No.: 09/102,935

[22] Filed: Jun. 23, 1998

[51] Int. Cl.[6] ..... F01N 1/08

[52] U.S. Cl. ..... 181/264; 181/280; 181/258

[58] Field of Search ..... 181/252, 255, 181/256, 258, 264, 268, 269, 272, 275, 279, 280, 282

[56] References Cited

U.S. PATENT DOCUMENTS

| | | | |
|---|---|---|---|
| D. 360,178 | 7/1995 | Thomas . | |
| 624,062 | 5/1899 | Matthews et al. | 181/264 |
| 2,229,913 | 1/1941 | Blanchard | 181/264 |
| 4,286,689 | 9/1981 | Malmsten | 181/272 |
| 4,693,339 | 9/1987 | Beale et al. . | |
| 4,890,691 | 1/1990 | Ching-ho | 181/264 |
| 5,196,653 | 3/1993 | Kiss . | |
| 5,198,625 | 3/1993 | Borla . | |
| 5,214,254 | 5/1993 | Sheehan . | |
| 5,248,859 | 9/1993 | Borla . | |
| 5,282,361 | 2/1994 | Sung . | |
| 5,611,409 | 3/1997 | Arseneau . | |

*Primary Examiner*—Khanh Dang
*Attorney, Agent, or Firm*—Wells, St. John, Roberts, Gregory & Matkin, P.S.

[57] ABSTRACT

An exhaust conditioning device, comprising a housing having an entrance duct, an exit duct, and a hollow interior defined within the housing between the entrance duct and the exit duct; a conical baffle carried coaxially within the housing downstream of the entrance duct and configured to form a generally outwardly extending compression chamber therebetween; and a frustoconical baffle carried coaxially within the housing downstream of the conical baffle and upstream of the exit duct and configured to form a generally inwardly extending compression chamber; wherein the conical baffle cooperates with the housing to form a conical vacuum chamber and the frustoconical baffle cooperates with the housing to form a substantially annular vacuum chamber, downstream of the conical vacuum chamber. In one form, the exhaust conditioning device comprises an exhaust muffler. Additionally, a method is disclosed.

19 Claims, 7 Drawing Sheets

MUFFLER/EXHAUST EXTRACTOR AND METHOD

TECHNICAL FIELD

This invention relates to a device and method for facilitating exhaust action and noise abatement of high velocity air or gas exhaust flow, and more particularly to a muffler for use with internal combustion engines.

BACKGROUND OF THE INVENTION

Various engines including internal combustion engines and turbine engines produce exhaust gases containing undesirable levels of noise. The problem of muffling and evacuating such exhaust gases is well known. Automobiles utilize exhaust systems that couple with an internal combustion engine and contain combinations of headers, collectors and mufflers. One type of muffler contains a plurality of chambers that are formed within a casing or housing by a plurality of baffles. The baffles are arranged to form a circuitous path from an inlet end of the housing to an exit end of the housing. Typically, sound-absorbing material such as stainless steel wool is also provided in portions of the housing to further reduce high frequency components of noise.

Another type of exhaust system component that facilitates evacuation of exhaust gases is disclosed in U.S. Pat. No. 5,282,361 to Sung. More particularly, a device is provided for facilitating exhaust action of an internal combustion engine. Induction and acceleration of air resistance is imparted from forward movement of a vehicle via a guided flow depression device and a forced exhaust device. However, little or no muffling is provided by the device.

Therefore, there is a need to provide a device and method that muffles exhaust gas noise. Furthermore, there is a need for a device and method that enhances evacuation of exhaust gases through an exhaust system. Even furthermore, there is a need to provide such device and method so as to improve engine operating efficiency by reducing back pressure at engine exhaust ports.

The present invention arose from an effort to develop a muffler that reduces exhaust system noise, reduces back pressure at the engine intake valves, imparts smoother exhaust flow, and improves exhaust evacuation from an engine and exhaust system. Such muffler provides these features in a manner that is relatively low cost, is relatively lightweight, has operating characteristics that can be easily tuned to a particular engine and exhaust system, and is resistant to rust and corrosion.

SUMMARY OF THE INVENTION

The present invention relates to a muffler and exhaust gas evacuator.

According to one aspect of the invention, a muffler includes an outer casing having an elongate configuration, a hollow interior, and an inlet end and an outlet end. End caps are mounted one at the inlet end and the other at the outlet end of the outer casing. Entrance and exit ducts are connected to and communicate respectively with the end caps at the inlet end and the outlet end of the outer casing. A conical diverging flow deflector is supported coaxially within the hollow interior of the outer casing adjacent the entrance duct. A funnel-shaped converging flow deflector is supported coaxially within the hollow interior of the outer casing, downstream of the conical deflector. The conical deflector forms a conical vacuum chamber, and the funnel-shaped deflector cooperates with the casing to form an annular-shaped vacuum chamber.

According to another aspect of the invention, an exhaust conditioning device includes a housing having an entrance duct, an exit duct, and a hollow interior defined within the housing between the entrance duct and the exit duct. A conical baffle is carried coaxially within the housing downstream of the entrance duct and is configured to form a generally outwardly extending compression chamber therebetween. A frustoconical baffle is carried coaxially within the housing downstream of the conical baffle and upstream of the exit duct. The frustoconical baffle is configured to form a generally inwardly extending compression chamber. The conical baffle cooperates with the housing to form a conical vacuum chamber and the frustoconical baffle cooperates with the housing to form a substantially annular vacuum chamber, downstream of the conical vacuum chamber.

According to yet another aspect of the invention, a method for conditioning exhaust of an internal combustion engine comprises: delivering exhaust gases from an internal combustion engine into a muffler housing containing a hollow interior; accelerating and compressing the exhaust gases within the housing by passing the exhaust gases through a generally outwardly extending compression chamber; dampening pressure variations within the exhaust gases by delivering the compressed exhaust gases adjacent a low pressure chamber; compressing and accelerating the exhaust gases within the housing by diverting the exhaust gases in a generally inwardly extending direction within a compression chamber; and removing the exhaust gases from the housing.

BRIEF DESCRIPTION OF THE DRAWINGS

Preferred embodiments of the invention are described below with reference to the following accompanying drawings.

FIG. 4 is a longitudinal cross-sectional view taken along line 4—4 of FIG. 2 illustrating construction features within the muffler;

FIG. 7 is a longitudinal cross-sectional view similar to that depicted in FIG. 4, but illustrating another alternative embodiment of the invention that contains sound-absorbing material;

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

One problem encountered with engines and exhaust systems on vehicles results from cam shaft overlap. During cam shaft overlap, the exhaust valve just starts to close as the intake valve just starts to open. Therefore, both valves are open at the same time for a brief instant. On stock exhaust systems found on many vehicles today, there exists so much back pressure at the exhaust port that, when the intake valve opens, burnt portions of fuel mixture get pushed back into the intake side of the motor. This occurrence creates an excessive amount of internal crankcase pressure which causes problems with engine seals, and results in inefficiencies by limiting air/fuel mixture that is entering the combustion chamber. According to innovative aspects of this invention, a muffler is utilized to create a vacuum, or relatively low pressure region, at selected points within the muffler. Such vacuum helps pull air/fuel mixture into an engine's combustion chamber, and also evacuates the chamber after firing of combustion gases, making the engine more efficient and saving the consumer fuel so as to increase mileage and decrease wear and tear on an engine.

According to the embodiments and implementation of this invention, such muffler construction saves wear and tear on an engine. Furthermore, by more fully evacuating the chambers on an engine, engine temperature is also decreased at the head, which increases the reliability of the engine. Accordingly, not as much heat will be present at the exhaust manifolds where heat might otherwise cause breakage or leakage around the heads. Accordingly, longevity is added to the heads and exhaust system on an engine. Furthermore, an engine will not be required to work as hard in order to evacuate a combustion chamber. Therefore, a consumer will not have to push on the engine throttle as much in order to achieve the same operating speed on a vehicle, therefore saving fuel consumption and adding to the vehicle's mileage capabilities for a given amount of fuel. Even furthermore, it has been found that the maintenance of a certain amount of heat at the manifolds enables the realization of a much more efficient burn out of the combustion chamber, reducing the amount of emissions produced therefrom.

Figure 1:
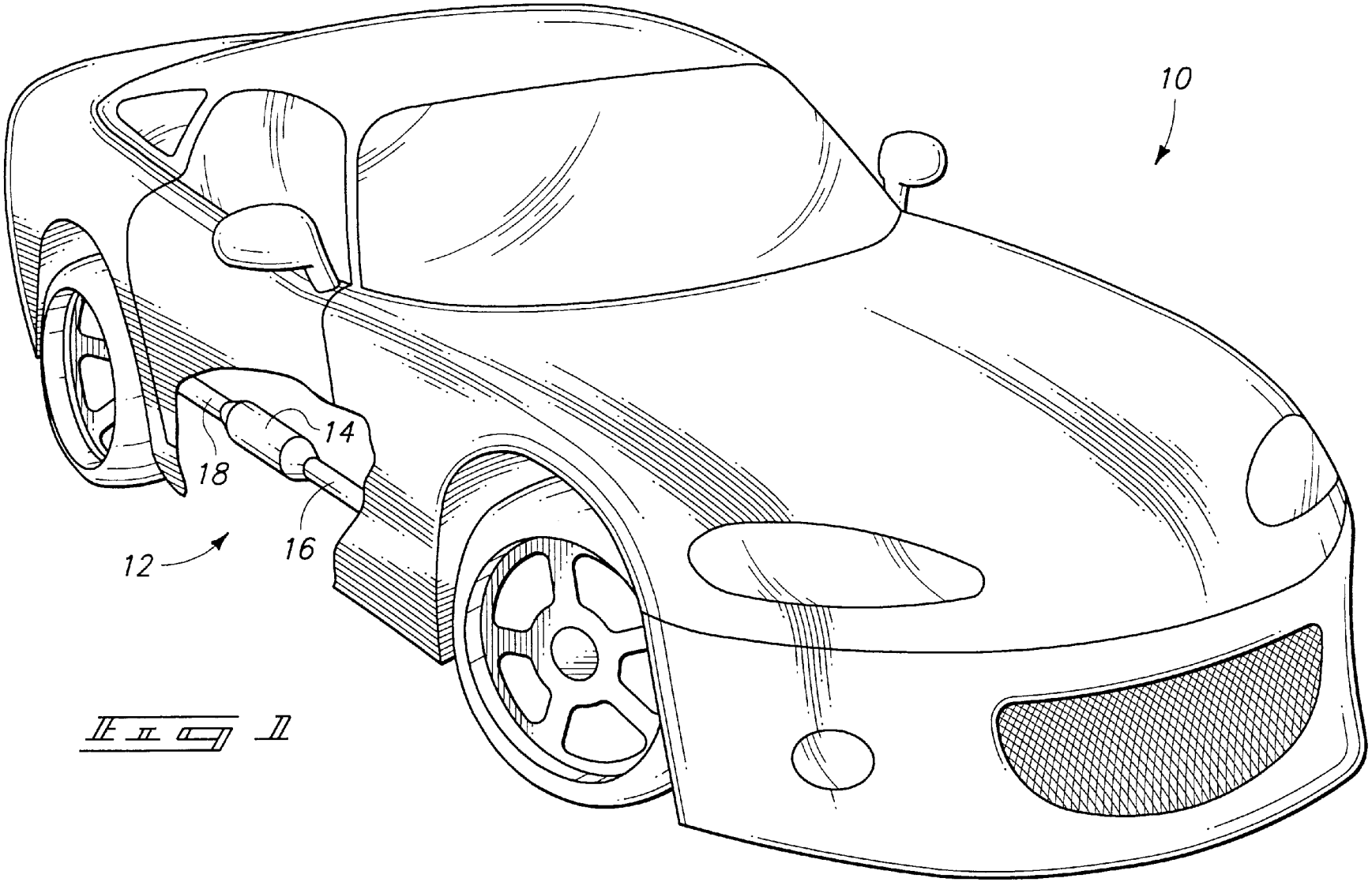
FIG. 1 is a perspective view of an automobile having an internal combustion engine with an exhaust system containing a preferred embodiment muffler according to one aspect of the invention.

A preferred embodiment of the invention is shown on an automobile 10 as a component of an exhaust system 12 and is embodied as a muffler generally designated with reference numeral "14" in FIG. 1. Exhaust system 12 is illustrated as an inlet pipe 16, muffler 14, and an outlet pipe 18. However, it is understood that inlet pipe 16 is fluid coupled with the exhaust valves of an internal combustion engine (not shown) via a pair of exhaust manifolds, headers, header pipes, a collector, and a catalytic converter.

According to one construction, inlet pipe 16 and outlet pipe 18 are welded directly onto opposite ends of muffler 14. According to another construction, muffler 14 includes an inlet duct and an outlet duct that each form short tubular segments extending from opposite ends of muffler 14. Such inlet duct and outlet duct are crimped so as to enable insertion within an end of inlet pipe 16 and outlet pipe 18, respectively. Typically, the inlet duct and the outlet duct are each circumferentially welded to inlet pipe 16 and outlet pipe 18, respectively.

Figures 2, 3:
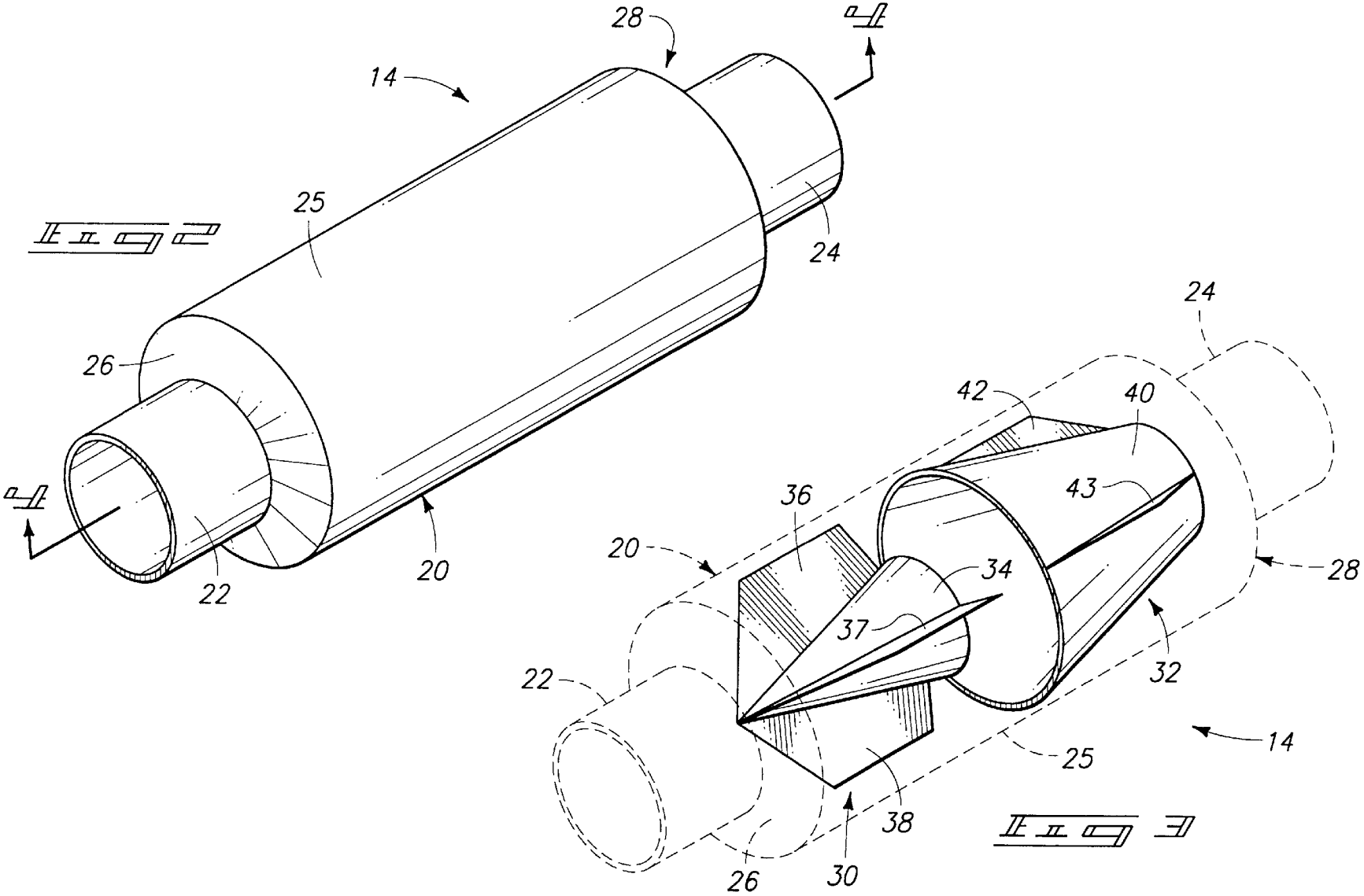
FIG. 2 is a perspective view illustrating the muffler depicted in FIG. 1.
FIG. 3 is a partial phantom view illustrating the internal baffles provided within the muffler of FIGS. 1 and 2.
Figure 2:
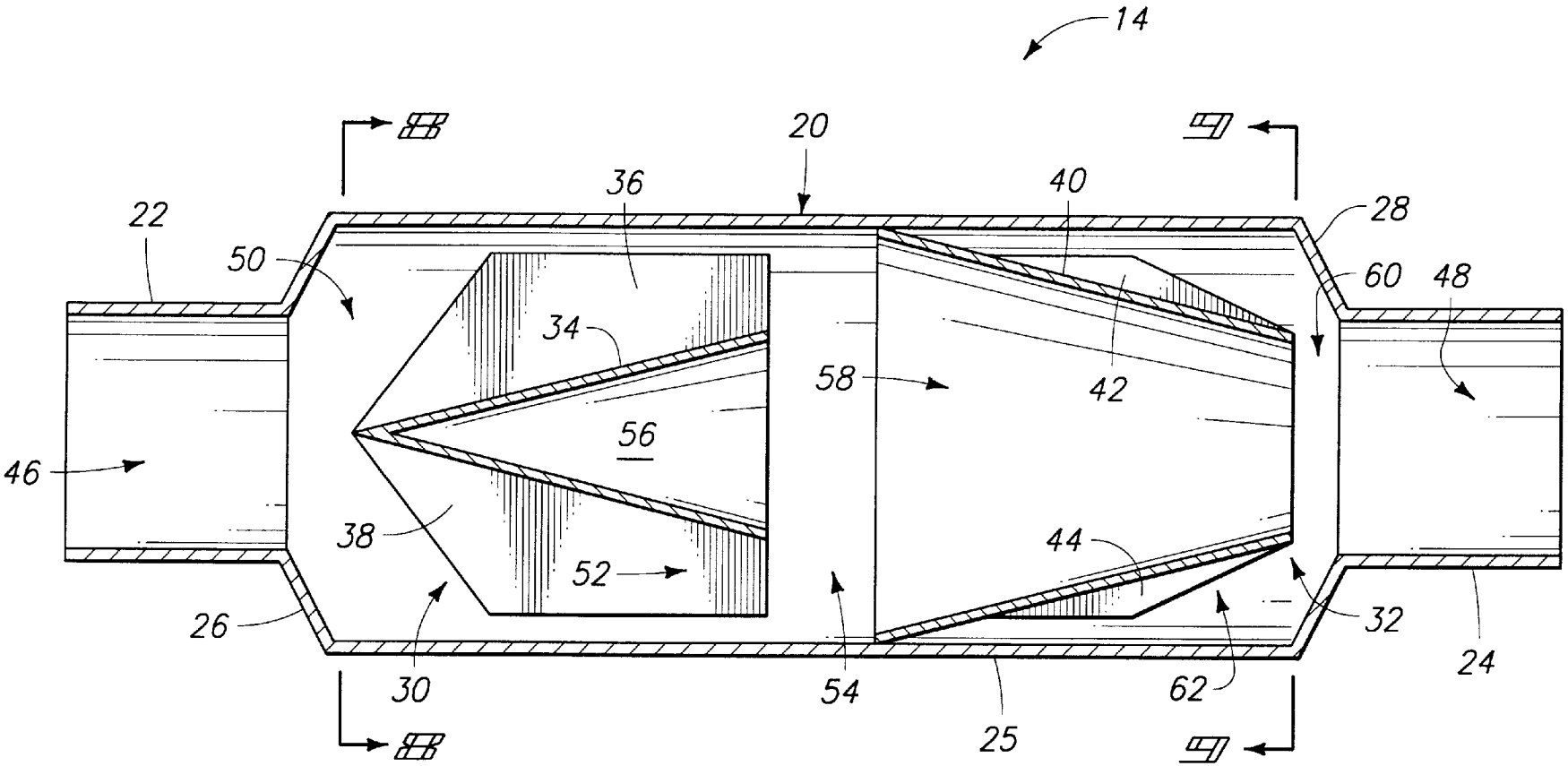

FIG. 2 illustrates in enlarged perspective view the construction of muffler 14. As shown in FIG. 2, muffler 14 is embodied with an inlet duct 22 and an outlet duct 24 formed at opposite ends of a cylindrical housing 20. A pair of end caps 26 and 28 are fitted to opposite ends of a tubular body 25 so as to form cylindrical housing 20. End cap 26 is also fitted to inlet duct 22, whereas end cap 28 is fitted to outlet duct 24.

According to the embodiment depicted in FIG. 2, housing 20 is formed in the shape of an elongated cylinder, with end caps 26 and 28 each being mated to opposite ends of tubular body 25. End caps 26 and 28 are each formed in the shape of a funnel, or shallow frustoconical tube. Each end cap 26 and 28 has a radial-inner circumferential edge the forms a radial-inner aperture along which one of ducts 22 and 24 is mated. Each one of end caps 26 and 28 has a radial outer circumferential edge along which such end cap is mated with housing 20.

According to one construction, end caps 26 and 28 are welded along a radial outer circumferential edge to respective cylindrical ends of tubular body 25 via a circumferential weld. Similarly, inlet duct 22 and outlet duct 24 are welded along such radial-inner circumferential edge to end caps 26 and 28, respectively. In this manner, end caps 26 and 28, ducts 22 and 24, and tubular body 25 cooperate to form housing 20.

Optionally, end caps 26 and 28 can be configured to form a flange along a radial outer edge and a flange along a radial inner edge such that each end cap is inserted within a circumferential opening at an associated end of tubular body 25. Accordingly, each end cap is then circumferentially welded to a respective end of tubular body 25 so as to join together the flange and body 20. Similarly, a respective one of ducts 22 and 24 is circumferentially welded to a similar flange on an associated radial inner edge of end cap 26 or 28.

Tubular body 25 and end caps 26 and 28 cooperate in assembly to form a torpedo-shaped chamber within housing 20. Accordingly, housing 20 has a hollow interior for muffling and evacuating exhaust gases received from an internal combustion engine via an exhaust system. It is understood that tubular body 25 and end caps 26 and 28, of housing 20, can be configured so as to impart a modified geometry to muffler 14. For example, housing 20 can be lengthened so as to lengthen individual chambers that are defined within such housing. Alternatively, housing 20 can be lengthened to provide for the incorporation of additional baffles, or flow deflectors, within such housing, as shown below with reference to FIG. 6. Even further, housing 20 can be configured to have a non-cylindrical cross-section. For example, housing 20 can be constructed with an elliptical cross-section. Similarly, end caps 26 and 28 can be configured to have a hemispherical or flat shape.

FIG. 3 depicts the internal structural features of muffler 14 with housing 20 shown in phantom. More particularly, FIG. 3 depicts the internal structural features of muffler 14, with tubular body 25, end caps 26 and 28, and ducts 22 and 24 shown in phantom to facilitate viewing. A pair of fluid flow deflecting baffle assemblies 30 and 32 are supported within housing 20 where they are welded into place.

Baffle assembly 30 comprises a cone-shaped baffle that is welded to an inner surface of tubular body 25, adjacent to inlet duct 22, and between inlet duct 22 and outlet duct 24.

Baffle assembly 32 is similarly supported within housing 20 where it is welded in place downstream of baffle assembly 30, and adjacent to outlet duct 24.

As shown in FIG. 3, the relative positioning and cooperation of baffle assemblies 30 and 32 within housing 20 generates a desired level of noise abatement and exhaust gas evacuation. Such benefits are realized by implementation of this invention as exhaust gases travel over baffle assemblies 30 and 32. More particularly, exhaust gases are delivered to muffler 12 via exhaust duct 20 where they pass over baffle assembly 30, and particularly over conical baffle 34 of assembly 30. Subsequently, such exhaust gases expand as they pass downstream of conical baffle 34, and enter a funnel-shaped frustoconical baffle 40 of baffle assembly 32. Such gases are compressed as they pass within frustoconical baffle 40, prior to being expanded and ejected from housing 20 via outlet duct 24.

Baffle assemblies 30 and 32 cooperate in assembly to impart compression and expansion to exhaust gases as such gases travel through housing 20, between inlet duct 22 and outlet duct 24. Such compression and expansion imparts noise cancellation, particularly to high frequency components, which significantly mitigates the transmission of noise therethrough. Additionally, baffle assemblies 30 and 32 each cooperate with housing 20 to generate a venturi effect immediately downstream of cone baffle 34 and frustoconical baffle 40, respectively, to produce a low pressure, or vacuum, region there adjacent.

Baffle assemblies 30 and 32 are each supported coaxially within cylindrical housing 20, in spaced-apart relation. Conical baffle 34 on assembly 30 forms a hollow interior on a downstream side, or inside, of conical baffle 34. Exhaust gases are compressed outwardly along the outside of conical baffle 34 and form a vacuum within the inside, or back side, of cone 34. Such vacuum is generated via a venturi effect that generates suction on the inside of cone 34. In this manner, it is presently believed, that a negative pressure area, relative to atmosphere, is created inside of cone 34 which generates a relative vacuum. Such vacuum facilitates the pulling of exhaust gases through housing 20, in a downstream direction around baffle assembly 30 and into baffle assembly 32.

Frustoconical baffle 40 of baffle assembly 32, which is positioned downstream of baffle assembly 30, receives and directs exhaust gases. More particularly, baffle 40 compresses and converges exhaust gases that are received from baffle assembly 30. Such exhaust gases are compressed and converged inwardly along a central axis as they pass through frustoconical baffle 40. An annular region extending between conical baffle 40 and housing 20 is formed around the exit of frustoconical baffle 40, which creates a segmented second negative (low) pressure, or vacuum chamber, there along. It is presently believed that such vacuum chamber is partially evacuated via a venturi effect that generates suction on the inside of a segmented annular region defined between frustoconical baffle 40 and an interior of housing 25.

Exhaust gases passing through frustoconical baffle 40 facilitate generation of a vacuum thereabout which further serves to pull exhaust gases through muffler 20 and out of outlet duct 24. Details of such vacuum or negative pressure chambers will be discussed below in greater detail with reference to FIGS. 4 and 5. The presence of such relatively low pressure regions, generated by baffles 34 and 40, is believed to impart a dampening effect to pressure pulses that might otherwise reflect and travel in an upstream direction through an exhaust system. Hence, the return of high pressure pulses to a header and manifold can be mitigated by the presence of such low pressure regions within a muffler.

According to the construction depicted in FIGS. 2 and 3, the components of cylindrical housing 20 are constructed from 14-gauge aluminized, or aluminum impregnated, mild steel. Namely, tubular body 25, inlet duct 22, outlet duct 24, and end caps 26 and 28 are each constructed from such aluminized mild steel. Additionally, baffle assemblies 30 and 32 are also formed from such 14-gauge aluminized mild steel. Alternatively, such components can be formed from mild steel where corrosion is not a concern. Even furthermore, such components can be formed from any of a number of various grades of stainless steel where cost is of less concern and the prevention of corrosion of high concern.

As illustrated in FIG. 3, baffle assembly 30 comprises a centrally located conical baffle 34 that is supported coaxially within the inner surface of housing 20 via a plurality of radially-extending fins 36–38. Although three equally spaced-apart and radially-extending fins 36–38 are depicted supporting conical baffle 34, it is understood that any of a number of fins can be utilized to support conical baffle 34 in coaxial relation within housing 20. Even furthermore, it is also understood that such fins 36–38 can be configured in any of a number of arrangements within housing 20 so as to support conical baffle 34 therein.

Figure 12:
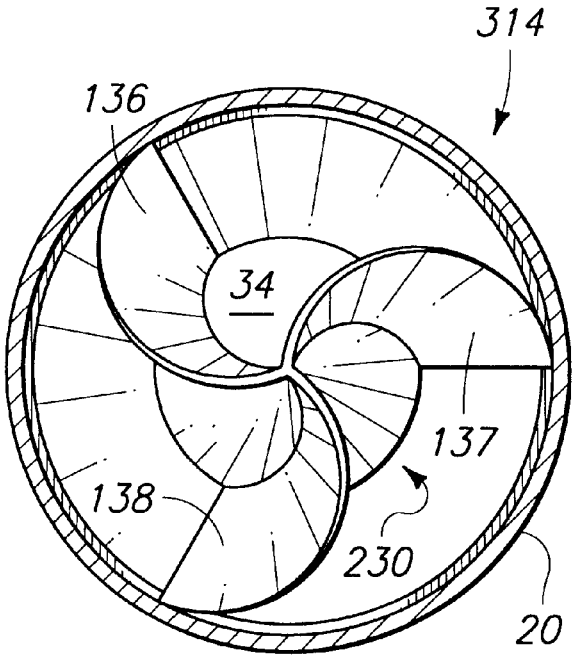
FIG. 12 is a cross-sectional view of even another alternative embodiment of the invention that contains helically shaped support fins taken at a location corresponding to the view depicted in FIG. 8.
Figure 13:
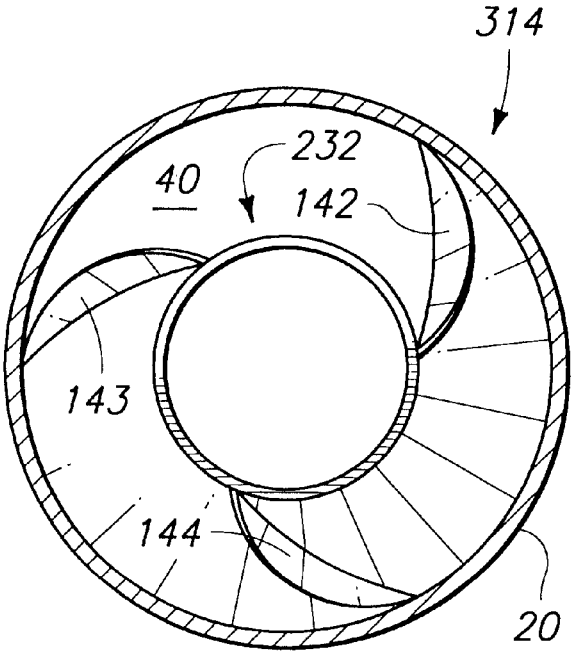
FIG. 13 is a cross-sectional view of the alternative embodiment depicted in FIG. 12, but taken at a location corresponding to the view depicted in FIG. 9.

For example, one alternative embodiment is depicted in FIGS. 12–13 wherein such fins are imparted with a helical configuration so as to swirl exhaust gases within housing 20, and along conical baffle 34 (as well as along frustoconical baffle 40). Further details of such embodiment will be described below with reference to FIGS. 12–13.

Also as shown in FIG. 3, baffle assembly 32 is formed from frustoconical baffle 40 which is shaped as a funnel, having a plurality of radially outwardly extending support fins 42–44. Fins 42–44 each extend radially outwardly from baffle 40 and are axially aligned to be parallel with the longitudinal axis of housing 20. Furthermore, fins 42–44 are equally spaced-apart about the outer circumference of frustoconical baffle 40. Fins 42–44 are welded to a radial outer surface of frustoconical baffle 40, then tack welded to an inner diameter surface of tubular body 25 of housing 20.

According to one construction, baffle assembly 30 is formed by edge welding each of fins 36–38 along an outer surface of conical baffle 34, then inserting such subassembly within housing 20 and tack welding the radial outer edges of fins 36–38 to an inner diameter of tubular member 25. Following such insertion and welding, baffle assembly 32 is similarly inserted and welded along fins 42–44, after which end caps 26 and 28 and outlet ducts 22 and 24 are welded to opposite ends of tubular body 25, respectively.

Figure 8:
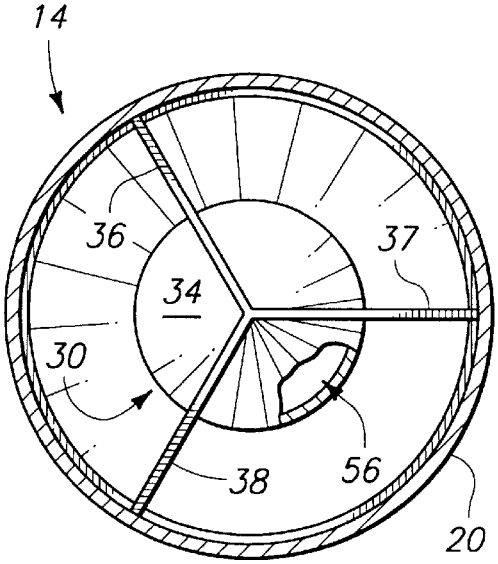
FIG. 8 is a cross-sectional view taken along line 8—8 of FIG. 4.
Figure 9:
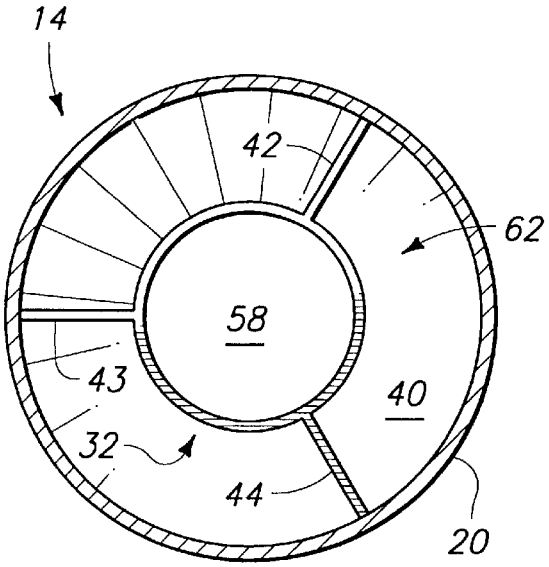
FIG. 9 is a cross-sectional view taken along line 9—9 of FIG. 4.

FIG. 4 illustrates the structural features of muffler 14 as taken in cross-sectional view along line 4—4 of FIG. 2. Such view has been taken in a directional parallel to the planer orientation of fins 38 and 44, as shown in FIG. 3. Accordingly, conical baffle 34 and frustoconical baffle 40 are shown in centerline sectional view, within housing 20 which is also shown in centerline sectional view. More particularly, the orientation and spacing of baffle assemblies 30 and 32 can be clearly seen within housing 20. FIGS. 8 and 9 further depict the structural features of muffler 14.

A muffler chamber is formed internally of housing 20 via cooperation of tubular member 25, end caps 26 and 28, as well as inlet duct 22 and outlet duct 24. An inlet port 46 is formed by inlet duct 26 through which exhaust gases enter muffler 20. It is understood that an inlet pipe of an exhaust system is welded to inlet duct 22, and an outlet pipe of an exhaust system is welded to outlet duct 24. In this manner, exhaust gases enter muffler 14 via inlet duct 22 where they expand within an expansion chamber 50 provided upstream of baffle assembly 30.

Exhaust gases then pass along conical baffle 34, between fins 36–38, where gas flow is diverted from along the axis of housing 20 in an outward manner. As a result, exhaust gases are compressed within a compression chamber 52 formed in three segments between fins 36–38. A second expansion chamber 54 is formed downstream of baffle assembly 30 where such compressed and accelerated exhaust gases are expanded. Exhaust gases exiting the downstream end of conical baffle 34 are accelerated to a high speed which imparts a venturi effect such that a vacuum chamber 56, formed within conical baffle 34, generates a vacuum source. Such vacuum source has a pressure below the adjacent exhaust gas pressures present in compression chamber 52. According to one implementation, such pressure is below atmospheric pressure.

Exhaust gases then travel from expansion chamber 54 where they enter a second compression chamber 58 formed within frustoconical baffle 40. Such exhaust gases are directed in an opposite radial direction than they were by baffle assembly 30; namely, such gases are compressed radially inwardly towards a central axial location within housing 20 until they exit from the downstream end of conical baffle 40. Another expansion chamber 60 is formed immediately downstream of conical baffle 40 where such exhaust gases are ejected at relatively high velocity. A small amount of expansion occurs within expansion chamber 60 before exiting through outlet duct 24 via outlet port 48. The passage of exhaust gases at high velocity through expansion chamber 60 generates a venturi effect adjacent an annular-shaped vacuum chamber 62 defined between frustoconical baffle 40 and the inner surface of housing 20, and between fins 42–44.

As best illustrated in FIG. 4, conical baffle 34 cooperates with body 25 to form a flow-directing generally outwardly extending compression chamber 52. Likewise, frustoconical baffle 40 forms a flow-directing generally inwardly extending compression chamber 58.

According to one construction, the embodiment depicted in FIGS. 1–5 is manufactured from components made from 14-gauge aluminized, or aluminum-impregnated, mild steel. Such aluminized steel is resistant to acidics that are generated by a catalytic converter provided in an exhaust system upstream of the muffler 14. Optionally, muffler 14 can be constructed from a stainless steel alloy. However, stainless steel tends to turn yellow when subjected to relatively high temperatures which aesthetically reduces the outward appearance of muffler 14.

Figure 5:
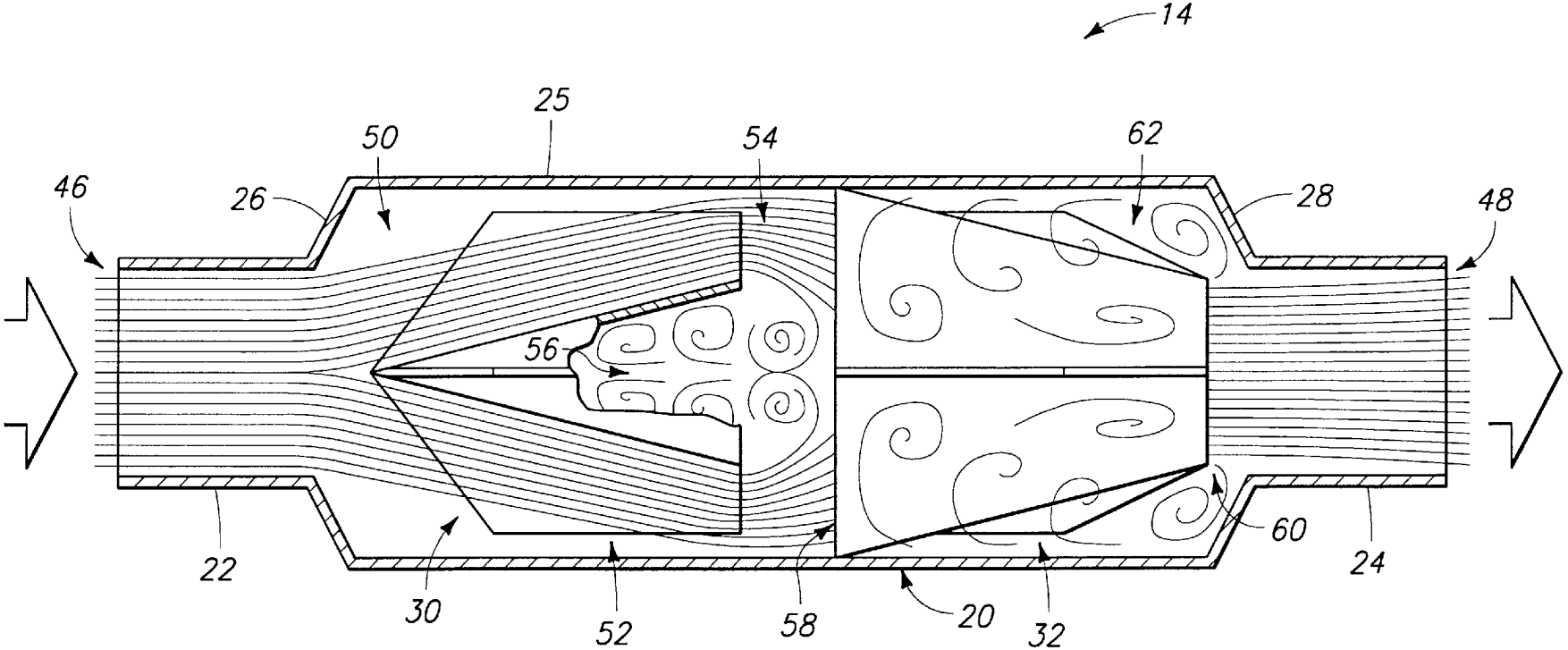
FIG. 5 is a diagrammatic illustration corresponding with the cross-sectional view depicted in FIG. 4, but showing fluid flow paths extending within the muffler.
Figure 5:
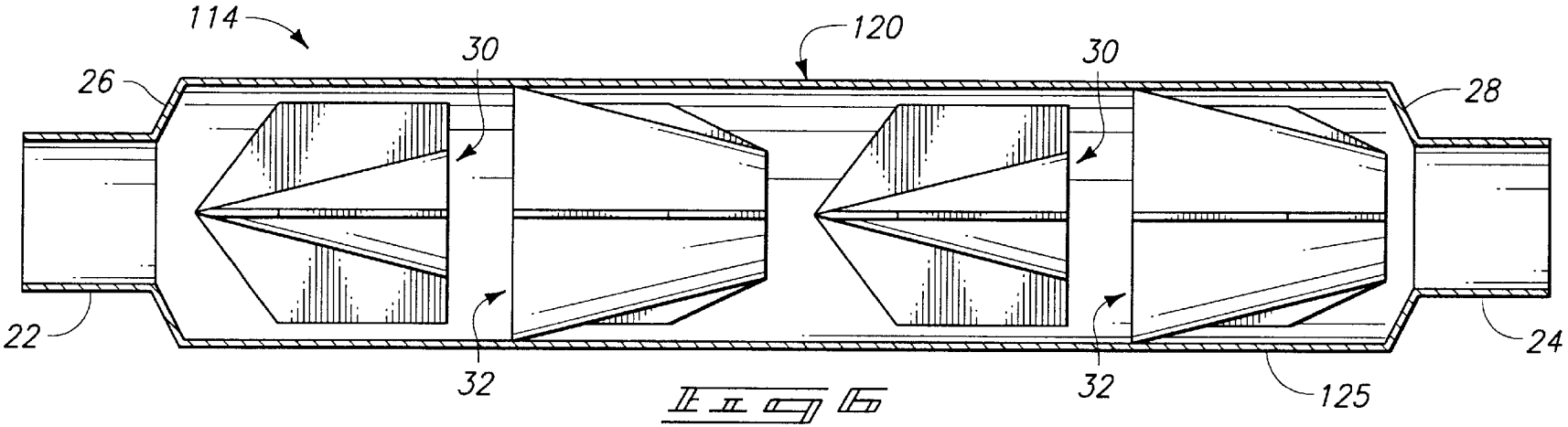

According to the construction depicted in FIGS. 4 and 5, tubular body 25 is six inches in diameter and approximately 13.9 inches in length. End caps 26 and 28 are frustoconically shaped so as to have an unassembled height, extending along the central axis, of approximately one-half of an inch. Inlet duct 22 and outlet duct 24 are each formed from a three-inch diameter piece of cylindrical aluminized mild steel tubing.

Conical baffle 34, of baffle assembly 30, is configured with a three-inch diameter base and a six-inch length extending along the central axis. Individual fins 36–38 are sized to have a radial outermost edge dimension of four inches in length, along which such fins mate to the inner wall of tubular body 25.

Frustoconical baffle 40, of baffle assembly 32, is configured with an upstream edge having a diameter of nearly six inches, and a downstream edge having a diameter of three inches. Accordingly, frustoconical baffle 40 is sized to have an axial length of 6.5 inches. Fins 42–44 are each sized so as to have a radial outermost edge length of four inches, along which such fins mate with an inner wall of tubular body 25.

FIG. 8 is a vertical sectional view taken through muffler 14 along line 8—8 of FIG. 4 and illustrating the configuration of baffle assembly 30 within cylindrical housing 20. The equally spaced radially-outwardly extending configuration for fins 36–38 can be readily seen. Furthermore, the coaxial alignment of conical baffle 34 within the cylindrical body of housing 20 is readily apparent. Accordingly, exhaust gases are delivered into housing 20 where they are diverted by conical baffle 34 in a circumferential and radially outwardly extending manner, causing such exhaust gases to compress and accelerate between conical baffle 34 and the inner wall of housing 20.

FIG. 9 is a vertical sectional view taken along line 9—9 of FIG. 4 illustrating the coaxial positioning of baffle assembly 32 within the cylindrical body of housing 20. As was the case with baffle assembly 30 depicted in FIG. 8, baffle assembly 32 is also carried coaxially within the inner surface of housing 20 by fins 42–44. Preferably, fins 42–44 in end-view are arrayed in alignment with fins 36–38 (of FIG. 8). Optionally, fins 42–44 can be offset with fins 36–38. Exhaust gases are accelerated by frustoconical baffle 40 where they exit at high velocity via a cylindrical aperture provided at a downstream end of compression chamber 58. The region defined between frustoconical baffle 40 and an inner wall of housing 20 provides for an annular vacuum chamber 62 that is divided into three segments by fins 42–44.

FIG. 5 is a diagrammatic vertical and partial centerline sectional view illustrating exhaust gas flow through muffler 14. Baffle assembly 30 is shown in partial breakaway view and baffle assembly 32 is shown in full side view. More particularly, flow lines depicting the passage of exhaust gases through muffler 14 can be seen extending from inlet port 46 of inlet duct 22 to outlet port 48 of outlet duct 24. Exhaust gases pass from inlet port 46 into expansion chamber 50 where such gases expand upon entering chamber 50. The exhaust gases are then diverted radially outwardly by baffle assembly 30 and compressed within compression chamber 52 where they are accelerated.

Accelerated exhaust gases exit compression chamber 52 and move radially inwardly within expansion chamber 54, causing a venturi effect that induces a negative pressure, or vacuum, within vacuum chamber 56. Vacuum chamber 56 imparts further draw on exhaust gases in the region of expansion chamber 54 which functions to assist in drawing exhaust gases from expansion chamber 54. Additionally, vacuum chamber 56 also functions to smooth out exhaust flow moving through muffler 14, and dampens pulsatile flow, or pressure variations, occurring within the exhaust gas of muffler 14. Accordingly, pressure pulses travelling within the exhaust gases of an exhaust system can be dampened via a muffler 14 of this invention.

Exhaust gases pass from expansion chamber 54 into compression chamber 58 where they are compressed and accelerated. Exhaust gases exit compression chamber 58 at a relatively high velocity and are ejected into expansion chamber 60. Such relatively high-velocity gases exit through expansion chamber 60 and into outlet port 48. The delivery of relatively high-velocity exhaust gases into expansion chamber 60 induces a low pressure region, or vacuum, in vacuum chamber 64.

Vacuum chamber 64 is located between the outer surface of baffle assembly 32 and the inner surface of housing 20. Such subdivided annular chamber 64 further facilitates the draw and passage of exhaust gases into expansion chamber 60, and serves to dampen out any pulsatile or reverberating pressure pulses contained within the muffler 14 of an exhaust system. Accordingly, vacuum chamber 62 comprises a large segmented, annular area extending around the outer periphery of baffle assembly 32. Such vacuum enhances the velocity of exhaust gases that exit baffle assembly 32 which imparts enhanced evacuation of exhaust gases through muffler 14. Accordingly, an engine that is coupled to such an exhaust system containing muffler 14 will see an increase in operating efficiency and performance.

Accordingly, as depicted in FIG. 5, a pair of low, or negative (relative to atmospheric pressure), pressure regions are generated by vacuum chambers 56 and 62. Cooperation of such vacuum chambers with adjacent high-velocity gases which exit compression chambers 52 and 58, respectively, imparts further evacuation of such gases and dampens out any reverse pressure pulses which might otherwise travel upstream of an exhaust system. For example, it is known in the art that an improperly tuned exhaust system might produce positive pressure pulses that reverberate upstream of an exhaust system. If a positive pressure pulse is located within an engine manifold when an exhaust valve is opened, such occurrence can cause negative, unwanted back flow into an engine. Accordingly, it is desirable to evacuate such exhaust gases and prevent such reverse pressure pulses from traveling upstream of an exhaust system. It is presently understood that the provision of vacuum chambers 56 and 62 significantly dampens and reduces the occurrence of positive pressure pulses traveling upstream through muffler 14. Accordingly, the tendency for unsteady state pressure pulses to reverberate within an exhaust system is significantly diminished and dampened.

The muffler embodiment illustrated in FIGS. 1–5 was tested on the exhaust system of a Vortech 350-cubic inch V8 engine, having an automatic transmission, and configured in a 1996 Chevrolet 1,500 4×4 pickup. A model No. 4L60E transmission and a 373 gear ratio were used. The test vehicle was run on a Bear chassis dynamometer Model No. 1132 in second gear. Measurements were made at 2,500, 3,000, 3,500 and 4,000 revolutions per minute (RPM) to determine the foot pounds of torque generated with such muffler. Additionally, a production Flowmaster muffler (part No. 43050) was compared with the stock (OEM) muffler (GM part No. 312548) provided on the 1996 Chevrolet 4×4 pickup, and with a Walker Superturbo Dynamax (part No. 17793). According to such results, the muffler embodiment depicted in FIGS. 1–5 generated 410 foot pounds of torque at 2,500 RPM, 390 foot pounds of torque at 3,000, 380 foot pounds of torque at 3,500 RPM, and 360 foot pounds of torque at 4,000 RPM. In comparison, the Flowmaster muffler generated 385 foot pounds of torque at 2,500 RPM, 390 foot pounds of torque at 3,000 RPM, 345 foot pounds of torque at 3,500 RPM, and 330 foot pounds of torque at 4,000 RPM. For further comparison, the OEM muffler generated 365 foot pounds of torque at 2,500 RPM, 370 foot pounds of torque at 3,000 RPM, 335 foot pounds of torque at 3,500 RPM, and 275 foot pounds of torque at 4,000 RPM. The Walker Superturbo Dynamax generated 375 foot pounds of torque at 2,500 RPM, 365 foot pounds of torque at 3,000 RPM, 340 foot pounds of torque at 3,500 RPM, and 310 foot pounds of torque at 4,000 RPM.

Additionally, exhaust gas temperatures were measured at the muffler. The muffler embodiment depicted in FIGS. 1–5 generated exhaust temperatures at the muffler of 730° F. The Flowmaster, OEM and Walker Superturbo Dynamax mufflers each generated exhaust temperatures in excess of 888° F.

Figure 6:
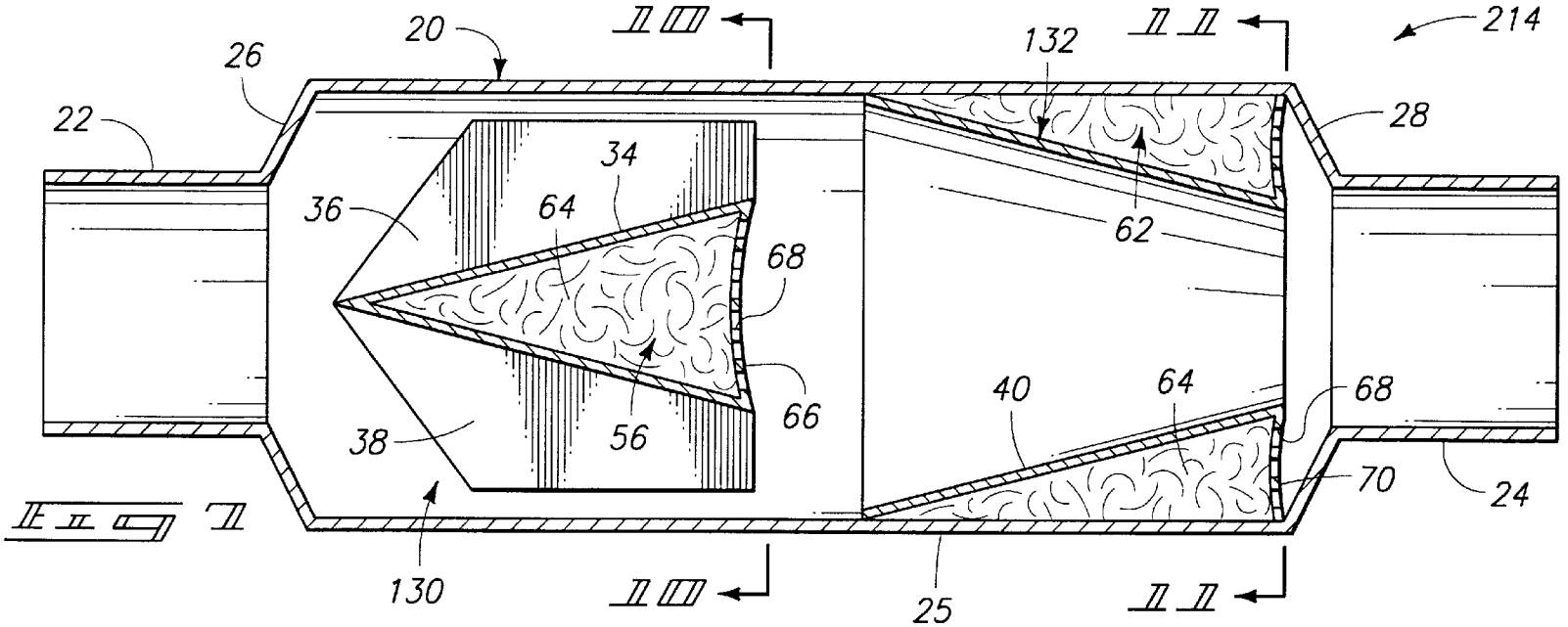
FIG. 6 is a longitudinal cross-sectional view similar to that depicted in FIG. 4, but illustrating an alternative embodiment of the invention containing a serial array of the pair of baffles utilized in the embodiment depicted in FIGS. 1–5.

In FIG. 6, an alternative embodiment muffler 114 is illustrated having an elongate housing 120 constructed similarly to housing 20 (of FIG. 2), but configured to be twice the length of housing 20. Housing 120 contains two pairs of baffle assemblies 30 and 32, provided in a serial arrangement. Accordingly, the operating principles described above with respect to FIGS. 2–5 are repeated twice within housing 120 as exhaust gases flow from inlet duct 22, through muffler 114, and through outlet duct 24. In the process, exhaust gas travels from inlet duct 22, around an upstream one of baffle assemblies 30, through an upstream one of baffle assemblies 32, around a downstream one of baffle assemblies 30, through a downstream one of baffle assemblies 32, and through outlet duct 24. It is understood that the compression, expansion and vacuum chamber characteristics described in detail with respect to FIGS. 4 and 5 also occur between each pair of baffle assemblies 30 and 32, contained within muffler 114. Accordingly, the operating characteristics of the embodiment depicted in FIGS. 1–5 are carried out twice within muffler 114, in a serial configuration.

As shown in FIG. 6, housing 120 includes tubular member 125, conical end caps 26 and 28, and inlet ducts 22 and 24, which are each formed from a piece of aluminized mild steel, similar to the construction described with reference to FIGS. 2–4. Likewise, baffle assemblies 30 and 32 are contained within housing 120 according to the construction details that were described with reference to FIG. 4.

The embodiment depicted in FIG. 6 enables further noise reduction of exhaust gases traveling through such muffler by carrying out the compression, expansion and dampening features depicted in FIG. 5 twice within the same muffler. Hence, additional sound attenuation is provided, additional pressure pulse dampening is provided, and additional enhancement of exhaust gas extraction is further provided according to such construction.

Figure 10:
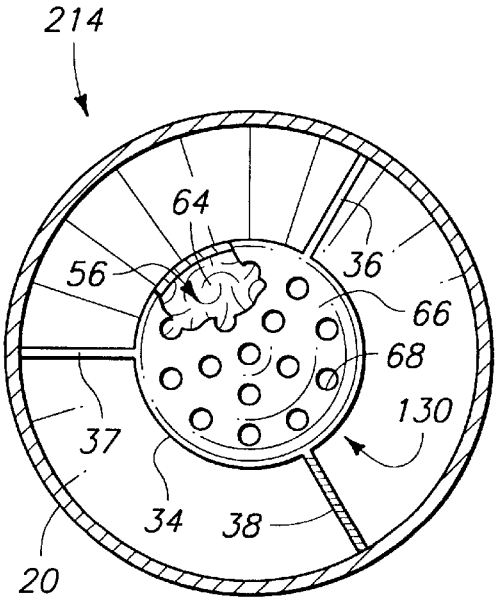
FIG. 10 is a cross-sectional view taken along line 10—10 of FIG. 7.
Figure 11:
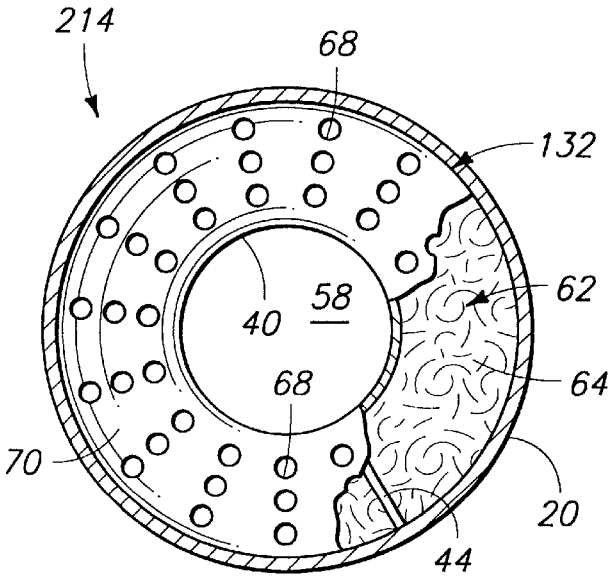
FIG. 11 is a cross-sectional view taken along line 11—11 of FIG. 7.

Another alternative embodiment is depicted in FIGS. 7 and 10–11 wherein additional sound-absorbing features are provided within a muffler 214. According to the construction depicted in FIG. 7, muffler 214 includes housing 20, which is constructed substantially identically with housing 20 depicted in FIG. 4. More specifically, housing 20 includes a tubular body 25, an end cap 26 and 28, and a respective duct 22 and 24, provided at each end, respectively. Additionally, a first baffle assembly 130 is provided upstream of a second baffle assembly 132. Baffle assembly 130 is constructed in a substantially similar manner to baffle 30 (of FIG. 4). However, the additional feature of sound-deadening material 64 is provided within vacuum chamber 56, and a perforated and concave cylindrical end plate 66 is used to encase such sound-deadening material 64 within vacuum chamber 56.

Concave end plate 66 is affixed at a downstream end of conical baffle 34 via a circumferential weld. End plate 66 is formed from a piece of 16-gauge aluminized mild steel containing a plurality of 3/16"-diameter perforations 68 spaced apart in a pattern along plate 66. Perforations 68 cooperate with the concave geometry of end plate 66 to enable the drawing of a vacuum or pressure reduction within vacuum chamber 56 via passage of accelerated exhaust gases there adjacent. Additionally, sound-deadening material 64 enhances the sound deadening, particularly of high-frequency components present within the adjacent exhaust gases. Also provided in the embodiment depicted in FIG. 7, sound-attenuating, or deadening, material 64 is provided within vacuum chamber 62. More particularly, a cylindrical, concave and perforated ring-shaped end plate 70 is circumferentially welded to a downstream end of frustoconical baffle 40, and along a radial outer edge with an inner surface of housing 20. Ring-shaped and concave end plate 70 is formed from a piece of 3/16" aluminized mild steel, and perforations 68 comprise 3/16"-diameter holes formed within plate 70. Perforations 68 comprise apertures that cooperate with the concave geometry of end plate 70 to reduce pressure within vacuum chamber 62.

According to one implementation, sound-deadening material 64 comprises relatively coarse, wiry metal material such as metal shavings that are generated from a machining operation, such as waste product generated by a metal lathe when turning a cylindrical piece of aluminized mild steel. One such configuration for sound-deadening material generated from a lathe-turning operation provides curled chips of waste material configured with a thickness of approximately 10–12 gauge. Alternatively, such sound-deadening material, or sound-attenuating material, can be formed from a metal wool such as stainless steel wool, composite materials, fiberglass, ceramic, glass wool, rock wool, or any other suitable sound-absorbing material capable of resisting breakdown when subjected to high temperature environments as encountered within a muffler and exhaust system. Accordingly, sound-absorbing material 64 is packed into vacuum chambers 56 and 62 where it is encased between the associated conical baffle 34 and end plate 66, or frustoconical baffle 40 and ring-shaped end plate 70, respectively.

In FIGS. 10 and 11, further construction details are provided for the alternative embodiment depicted in FIG. 7. More particularly, FIG. 10 is a vertical cross-sectional view taken along line 10—10 of FIG. 7 illustrating the downstream end of baffle assembly 130. Likewise, FIG. 11 is a cross-sectional view taken along line 11—11 of FIG. 7 and illustrating the downstream end of baffle assembly 132.

Baffle assembly 130 is depicted in FIG. 10 in partial breakaway view so as to enable visualization of sound-absorbing material 64 which is contained within vacuum chamber 56, and behind perforated, concave end plate 66. Additionally, the arrangement of individual perforations 68 can be readily visualized. Exhaust gases are accelerated by baffle assembly 130 such that a vacuum is generated via concave end plate 66 and through apertures 68 inside of vacuum chamber 56. Accordingly, a low pressure region is generated within vacuum chamber 56 which aids in drawing exhaust gases through muffler 214.

As shown in FIG. 11, a downstream end view of baffle assembly 132 clearly illustrates the arrangement of perforated apertures 68 provided within ring-shaped end plate 70. More particularly, exhaust gases are accelerated through compression chamber 58 where they exit downstream of baffle assembly 132. Accordingly, the venturi effect generates a vacuum via apertures 68 inside vacuum chamber 62.

In FIG. 12, yet another alternative embodiment is depicted wherein housing 20 is formed substantially identical to the embodiment of FIGS. 1–5, but wherein baffle assembly 230 (see FIG. 12) and baffle assembly 232 (see FIG. 13) are configured to have a plurality of support fins 136–138 and 142–144, respectively, that are formed in a helical configuration. Such helical configuration is operative to impart rotation of exhaust gases flowing there along.

According to the construction depicted in FIG. 12, fins 136–138 are each formed from a piece of 16-gauge aluminized mild steel that is roll-formed to impart a helical geometry extending along conical baffle 34. Exhaust gases are delivered to impinge on conical baffle 34 where such gases are compressed between baffle 34 and an inner surface of housing 20, and further imparted with rotation by the helical surfaces presented by fins 136–138.

FIG. 13 illustrates an alternatively constructed baffle assembly 232 that can be provided in conjunction with the baffle assembly 230 of FIG. 10. More particularly, fins 142–144 are roll-formed so as to impart a helical configuration, similar to that imparted to fins 136–138 (of FIG. 12). Optionally, fins 142–144 can be stamped via a press to obtain the desired helical configuration. Fins 142–144 serve to support baffle assembly 232 from the radial inner surface of housing 20. Additionally, the helical configuration imparted by baffles 142–144 further cooperates to impart swirling of gases as they are ejected from frustoconical baffle 40, wherein a venturi effect applies vacuum which is at least partially affected by swirling induced via fins 142–144.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A muffler, comprising:

an outer casing having an elongate configuration, a hollow interior, an inlet end, and an outlet end;

end caps mounted one at the inlet end and the other at the outlet end of the outer casing;

entrance and exit ducts connected to and communicating respectively with the end caps at the inlet end and the outlet end of the outer casing;

a plurality of flow-directing fins carried by the outer casing and extending within the hollow interior:

a conical diverging flow deflector supported coaxially within the hollow interior of the outer casing by at least two of the flow-directing fins, adjacent the entrance duct; and a funnel-shaped converging flow deflector supported coaxially within the hollow interior of the outer casing, downstream of the conical deflector;

the conical deflector forming a conical vacuum chamber, and the funnel-shaped deflector cooperating with the casing to form an annular-shaped vacuum chamber.

2. The muffler according to claim 1 wherein the conical flow deflector comprises a conical baffle supported downstream of the entrance duct and within the outer casing.

3. The muffler according to claim 2 wherein the conical flow deflector further comprises a plurality of equally spaced-apart and radially outwardly extending support fins configured to support the conical baffle coaxially within the hollow interior of the outer casing.

4. The muffler according to claim 1 wherein the funnel-shaped flow deflector comprises a frustoconical baffle supported downstream of the conical flow deflector and upstream of the exit duct.

5. The muffler according to claim 4 wherein the funnel-shaped flow deflector further comprises a plurality of equally spaced-apart and radially outwardly extending fins configured to support the frustoconical baffle coaxially within the hollow interior of the outer casing.

6. The muffler according to claim 1 wherein the outer casing comprises an elongate tubular body.

7. The muffler according to claim 6 wherein the end caps each comprise a frustoconically shaped end cap affixed to either end of the elongate tubular body.

8. The muffler according to claim 1 wherein the outer casing, end caps, and entrance and exit ducts cooperate to form an elongate cylindrical housing.

9. The muffler according to claim 1 further comprising a concave and perforated end plate affixed to a downstream end of the conical flow deflector, the concave and perforated end plate cooperating with the conical flow deflector so as to define the conical vacuum chamber.

10. The muffler according to claim 1 further comprising a concave and perforated ring-shaped end plate secured to a downstream end of the funnel-shaped flow deflector and cooperating with the funnel-shaped flow deflector so as to define the annular-shaped vacuum chamber.

11. A method for conditioning exhaust of an internal combustion engine, comprising:

delivering exhaust gases from an internal combustion engine into a muffler housing containing a hollow interior;

compressing, guiding and accelerating the exhaust gases within the housing by passing the exhaust gases through a generally outwardly extending compression chamber having flow-directing fins;

dampening pressure variations within the exhaust gases by delivering the compressed exhaust gases adjacent a low pressure chamber;

compressing and accelerating the exhaust gases within the housing by diverting the exhaust gases in a generally inwardly extending direction within a compression chamber; and removing the exhaust gases from the housing.

12. A method according to claim 11 further comprising the step of dampening pressure pulse variations within the exhaust gases following delivering the exhaust gases in a generally inwardly extending compression chamber by associating the compressed exhaust gases with a second low pressure chamber prior to evacuating the exhaust gases from the housing.

13. An exhaust conditioning device, comprising:

a housing having an entrance duct, an exit duct, and a hollow interior defined within the housing between the entrance duct and the exit duct;

a conical baffle carried within the housing downstream of the entrance duct and configured to form a generally outwardly extending compression chamber therebetween, the conical baffle cooperating with the housing to form a first vacuum chamber;

a frustoconical baffle carried within the housing downstream of the conical baffle and upstream of the exit duct and configured to form a generally inwardly extending compression chamber, the frustoconical baffle cooperating with the housing to form a second vacuum chamber; and a perforated end plate affixed to a downstream end of one of the conical baffle and the frustoconical baffle so as to at least in part define the respective first vacuum chamber or second vacuum chamber.

14. The exhaust conditioning device of claim 13 wherein the perforated end plate is affixed to a downstream end of the conical baffle, the conical baffle and the perforated end plate cooperating so as to define a conical vacuum chamber therebetween.

15. The exhaust conditioning device of claim 14 further comprising sound-absorbing material interposed between the conical baffle and the perforated end plate.

16. The exhaust conditioning device of claim 13 wherein the end plate comprises a concave and perforated end plate affixed to a downstream end of the conical baffle, the concave and perforated end plate cooperating with the conical baffle to form the first vacuum chamber, wherein the first vacuum chamber comprises a conical vacuum chamber.

17. The exhaust conditioning device of claim 13 wherein the end plate comprises a perforated ring-shaped end plate carried at a downstream end of the frustoconical baffle, the frustoconical baffle, housing and ring-shaped end plate cooperating to form the second vacuum chamber, wherein the second vacuum chamber comprises an annular vacuum chamber.

18. The exhaust conditioning device of claim 17 further comprising sound-absorbing material interposed between the housing, the frustoconical baffle, and the ring-shaped end plate.

19. The exhaust conditioning device of claim 13 wherein the end plate comprises a concave and perforated ring-shaped end plate carried at a downstream end of the frustoconical baffle, and cooperating with the frustoconical baffle and the housing so as to define the second vacuum chamber, wherein the second vacuum chamber comprises an annular-shaped vacuum chamber.

* * * * *